United States Patent [19]

Mueller et al.

[11] 4,301,660

[45] Nov. 24, 1981

[54] HEAT PUMP SYSTEM COMPRESSOR FAULT DETECTOR

[75] Inventors: Dale A. Mueller, St. Paul; Stephen L. Serber, New Hope, both of Minn.

[73] Assignee: Honeywell Inc., Minneapolis, Minn.

[21] Appl. No.: 120,454

[22] Filed: Feb. 11, 1980

[51] Int. Cl.[3] ..... F25B 49/00; F25B 13/00

[52] U.S. Cl. ..... 62/126; 62/160

[58] Field of Search ..... 62/125, 126, 127, 129, 62/160, 208, 209, 324 R

[56] References Cited

U.S. PATENT DOCUMENTS

| | | | |
|---|---|---|---|
| 4,236,379 | 12/1980 | Mueller | 417/32 |
| 4,246,763 | 1/1981 | Mueller et al. | 62/209 |
| 4,253,130 | 2/1981 | Newell | 62/324.1 |

*Primary Examiner*—Albert J. Makay
*Assistant Examiner*—Harry Tanner
*Attorney, Agent, or Firm*—Roger W. Jensen

[57] ABSTRACT

A compressor fault detection and control system for a reverse cycle refrigeration system for detecting faulty compressor operation and for controlling the system in response to the detection of a fault by inhibiting the compressor and for providing a fault indication, the control system comprising a controller means receiving inputs indicative of the outdoor coil temperature, the temperature of the compressor discharge refrigerant, and an output indicative of a demand from an enclosed space temperature sensing means for heating or cooling of the enclosed space. The controller means also includes timing means and means for comparing the value of the compressor discharge temperature and the value of the outdoor coil temperature. Further, the controller means has an operative connection to control means for controlling the operation of the compressor and functioning, after the compressor has been operating for a preselected time interval, to inhibit any further operation of the compressor means unless the value of the compressor discharge temperature is greater than the value of the outdoor coil temperature plus a preselected constant value.

5 Claims, 3 Drawing Figures

HEAT PUMP SYSTEM COMPRESSOR FAULT DETECTOR

BACKGROUND OF THE INVENTION

One significant problem with heat pumps is a possible system malfunction whereby the thermostat for the space to be heated and/or cooled by the heat pump commands compressor operation so as to either heat or cool the space but the compressor either does not operate or, in some cases, cycles on and off. Another possible system malfunction is where the compressor is energized and running but is not compressing the refrigerant; this can occur because of compressor valve failures and/or the loss of refrigerant. There are usually no obvious indications of these faults to a person located near the thermostat because the compressor is typically located remote from the thermostat. With many systems this can means (when the thermostat is calling for heating of the building) that auxiliary electric resistance heating is automatically used to heat the building, i.e., a backup heating system; however, this usually results in a much higher cost of heating. Accordingly, various prior art schemes have been devised for attempting to detect whether or not the compressor is running, or is running without pumping refrigerant in the system, but all of these prior art arrangements have one or more shortcomings. For example, one prior scheme is to use the pressure of the refrigerant at the discharge side of the compressor; however, this does not provide a reliable enough signal. Also, it has been proposed that the value or magnitude of the electric current and/or electric voltage energizing the motor driving the compressor be monitored; however, these schemes only indicate that the motor is being powered and do not confirm that the compressor is actually pumping refrigerant.

Another prior art arrangement is that set forth in the co-pending patent application of Dale A. Mueller and Stephen L. Serber, Ser. No. 954,266, filed Oct. 24, 1978 U.S. Pat. No. 4,246,763, wherein compressor fault detection is provided by monitoring the difference between the temperature of the discharge of the compressor and the temperature of the outside or outdoor air. The present invention is similar to that disclosed in said co-pending application of the applicants but is an improvement thereover in that the outdoor air temperature sensor is replaced by an outdoor coil temperature sensor which offers several technical advantages and also a cost advantage, all of which will be explained in more detail below.

An object of the present invention therefore is to provide a significantly improved compressor fault detection system for a reverse cycle refrigeration system.

SUMMARY OF THE INVENTION

The present invention is a compressor start-up fault detection and control system for a reverse cycle refrigeration system comprising the usual refrigeration compression means, indoor coil, outdoor coil, refrigerant conduit means connecting the compression means and the coils, and refrigerant compression control means. In particular, the compressor fault detection and control system comprises outdoor coil temperature sensing means having an output indicative of outdoor coil temperature, compressor discharge sensing means having an output indicative of the temperature of the refrigerant discharged from the refrigerant compression means, building temperature sensing means having an output indicative of a demand for heating or cooling of the building, and a special controller means. The special controller means has operative connections to the above recited temperature sensing means so as to receive the outputs thereof. The controller has a timing function which is initiated upon the starting or commencement of operation of the compressor. The controller means further includes a circuit connection-disconnection means for selectively interconnecting the building temperature sensing means to the refrigerant compression control means, the building temperature sensing means output normally being connected to the refrigerant compression control means so as to cause the compressor to run or operate whenever there is a demand for heating or cooling of the building. The controller means further is characterized by being adapted to inhibit the operation of the compressor means if, after a predetermined time interval as measured by the timing means, the value of the discharge temperature is less than the value of the outdoor coil temperature plus a preselected constant $K_1$.

The invention may further include a compressor "stop" detection means i.e., a means of monitoring the operation of the compressor after the above described start-up fault detection means has already established that the compressor had started in a satisfactory manner and operative to signal a malfunction if the compressor subsequently ceases to operate in the normal manner.

Thus the present invention provides (i) a means of detecting, within a preselected time, when a compressor has started and is correctly compressing, and (ii) a means of detecting when the compressor has stopped from a running condition; the two means may be used separately, together, and/or in conjunction with other control apparatus.

DESCRIPTION OF THE PREFERRED EMBODIMENT

Figure 1:
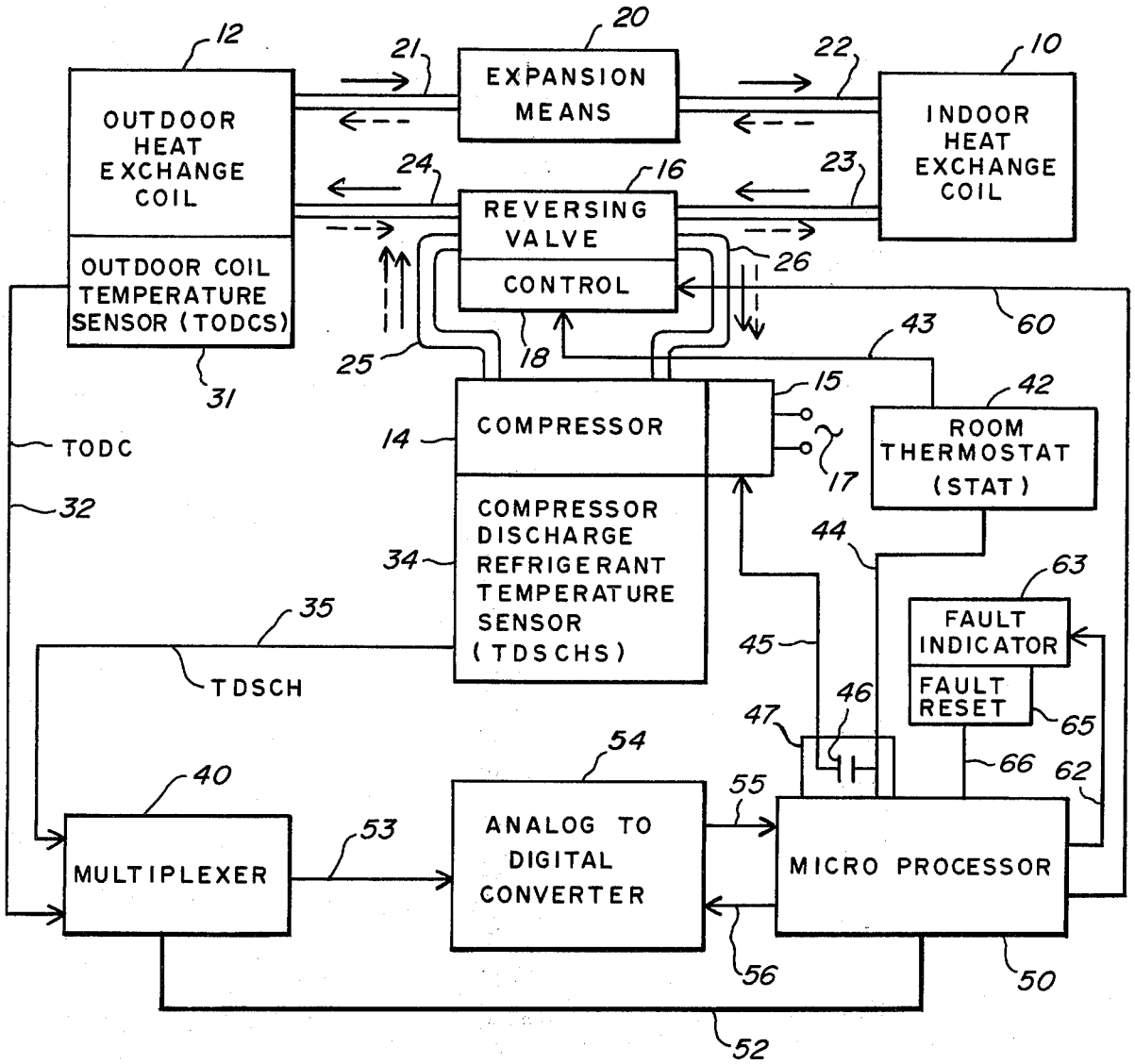
FIG. 1 is a block diagram of a compressor fault detection and control system for a reverse cycle refrigeration system embodying the present invention.

Referring to FIG. 1, the reverse cycle refrigeration system comprises an indoor heat exchange coil 10, an outdoor heat exchange coil 12, and refrigerant compression means or compressor 14, a compressor controller 15 energized from an appropriate source 17 of electrical energy, and refrigerant conduit means interconnecting the coils and compressor, the conduit means including the usual reversing valve 16 having a controller 18, an expansion means 20, and appropriate interconnecting piping 21–26. The system above described is representative of prior art systems such as that shown in the U.S. Pat. No. 3,170,304. As is well known, such systems function whenever the building thermostat is calling for heating or cooling to cause the compressor 14 to operate. If heating is being demanded, then the compressed hot refrigerant from the compressor 14 will be routed through the reversing valve 16 toward the indoor heat exchange coil 10 where its heat is given up to heat indoor air. Conversely, if cooling of the building is being demanded, then the hot refrigerant from the compressor is routed through the reversing valve to the outdoor heat exchange coil where the refrigerant is cooled for subsequent use indoors to cool the building.

The compressor fault detection and control system as depicted in FIG. 1 comprises an outdoor heat exchange coil temperature sensing means 31 (hereinafter sometimes referred to as "TODCS") having an output 32 on which is a signal indicative of the outdoor heat exchange coil temperature (hereinafter sometimes referred to as "TODC"). TODC on 32 comprises one of two inputs to a multiplexer 40 to be described in more detail below. The compressor fault detection and control system further comprises a compressor discharge refrigerant temperature sensing means (hereinafter sometimes referred to as "TDSCHS") 34 having an output 35 (connected to multiplexer 40 as the second input thereof) on which is a signal indicative of the temperature of the refrigerant on the discharge side of compressor 14, said temperature hereinafter sometimes being referred to as "TDSCH". The detection and control system further includes a room thermostat 42 (hereinafter sometimes referred to as "STAT") which responds to the temperature of a room or space in a building or the like, the temperature of which is to be controlled by the reverse cycle refrigeration system. Room thermostat 42 is depicted as having a first output 43 connected to the control 18 for the reversing valve 16 and a second output 44 connected to a microprocessor 50 and also, through a set of normally closed contacts 46 and a connection means 45, to the controller 15 of compressor 14. Contacts 46 are contained within a subsection 47 of the microprocessor 50 and both 47 and 50 will be described in more detail below.

A Honeywell Inc. Model T872 heating-cooling thermostat may be used for the room thermostat 42 depicted in FIG. 1, the Model T872 being of the bimetal operated mercury switch type including switch means for providing the heating-cooling control signals and also for controlling a plurality of auxiliary heating means. As will be understood, whenever STAT 42 calls for either heating or cooling of the controlled space, then a control signal is effectively supplied on outputs 43 and 44 thereof, the control signal at 43 functioning to position via control 18 the reversing valve 16 to the proper orientation for either heating or cooling of the building and the control signal at 44 being transmitted through the normally closed contacts 46 and connection 45 to control the compressor 14 from a rest or "off" position to an operating or "on" condition. The control signal at 44 is also applied to the microprocessor 50 to indicate a demand for compressor 14 operation.

Further, Honeywell Inc. platinum film resistance type temperature sensor models C800A and C800C may be used for TODCS 31 and TDSCHS 34 respectively. Also, a Westinghouse Inc. HI-RE-LI unit comprising an outdoor unit model No. HL036COW and indoor unit AG012HOK may be used for the basic heat pump unit depicted in FIG. 1; i.e., components 10, 12, 14, 15, and 16.

Multiplexer 40 thus has applied thereto at 32 and 35 analog signals representative of TODC and TDSCH respectively. The function of the multiplexer 40 is to supply one or the other of the two input signals in analog form to the output 53 thereof, depending upon the nature of a control signal being applied to the multiplexer 40 via a lead 52 from the microprocessor 50; i.e., the microprocessor provides a control for the multiplexer 40 to select which of the two input signals is applied to output 53. Output 53 is applied as the input to a standard analog-to-digital converter 54 (hereinafter sometimes referred to as "A/D") having an output 55 connected as a second input to the microprocessor 50 and also having an input 56 for receiving controlling instructions from the microprocessor 50. The output from A/D converter 54 at output 55 is a signal in digital form indicative of the analog signal applied to input 53.

The microprocessor has a first output 60 connected to the control 18 of the reversing valve 16 so as to, if desired, control the reversing valve independently of the control supplied to 18 from the room thermostat 42. The microprocessor 50 has a second output 62 connected to a suitable fault indicator 63 such as a warning light and/or audible alarm or the like. The apparatus further includes a suitable fault reset means 65 (such as a switch) having an output 66 which constitutes a third input to the microprocessor 50.

A suitable microprocessor that may be used in the present invention as a component of the system depicted in FIG. 1 is the Intel Corporation Model 8049; a suitable representative analog-to-digital converter for use to provide the function of block 54 in FIG. 1 is the Texas Instrument Inc. Model TL505C (see TI Bulletin DL-S 12580); and an appropriate multiplexer is the Motorola Inc. Model MC14051BP.

It will be understood by those skilled in the art that the functional interconnections depicted in FIG. 1 are representative of one or more electrical wires or pipes, as the case may be, as dictated by the specific equipment used. Also it will be understood that the temperature of the outdoor coil TODC can be determined by indirect methods such as by the measurement of the pressure of the refrigerant in the outdoor coil.

Figure 2A:
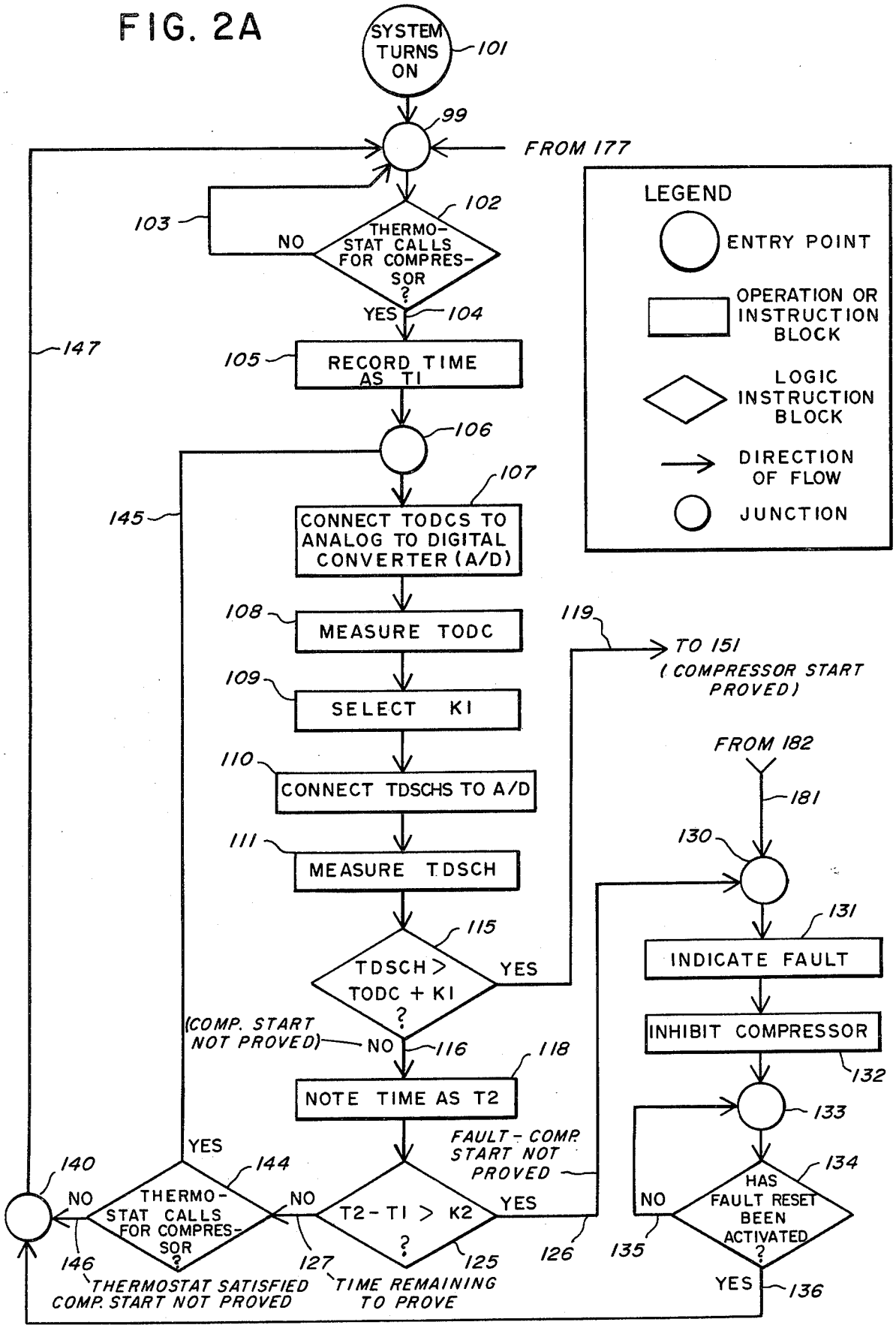
FIGS. 2A and 2B comprise a flow chart for the control of the apparatus shown in FIG. 1.
Figure 2B:
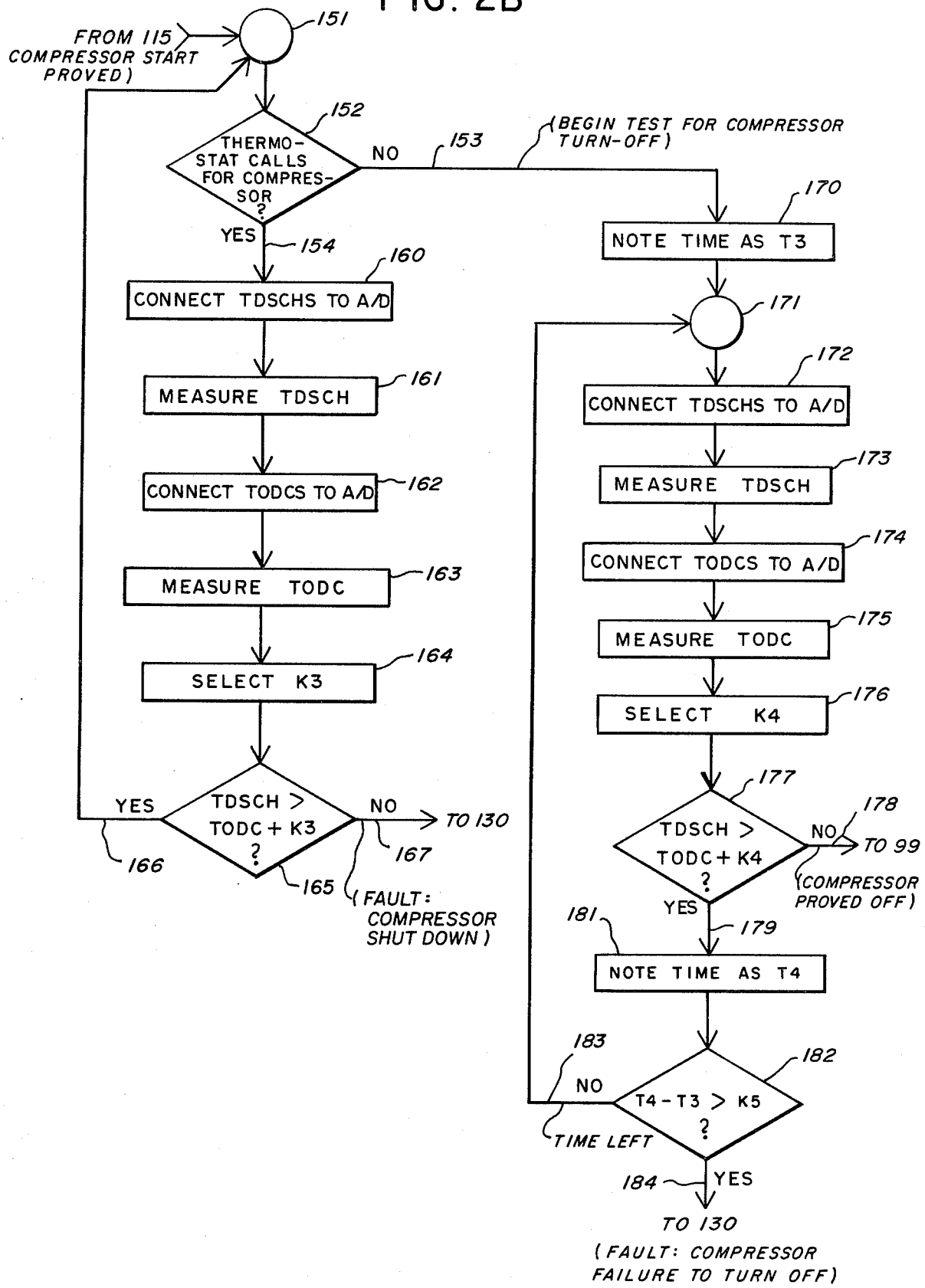

The detailed operation of the compressor fault detection and control system of FIG. 1 may be more specifically understood by reference to the flowcharts depicted in FIGS. 2A and 2B.

Preliminarily, it will be understood that, when the compressor starts, the temperature of the refrigerant at the compressor discharge begins to rise from its steady state off condition near the compressor ambient air temperature. Simultaneously, the coil temperature changes; getting colder than ambient in the heating mode and warmer than ambient in the cooling mode. In a short period, typically less than five minutes, these temperatures reach their steady state operating values. If the compressor fails to pump refrigerant properly, the difference between the two temperatures will not be established within the normal settling time. The presence of a temperature difference can be detected and used as a criterion for proving that the compressor is running.

The minimum temperature difference may be determined in one of two ways. The first method uses a single difference criterion which accounts for the fact that the difference is reduced in the cooling mode due to the increase in outdoor coil temperature. The second method uses two setpoints, one for the heating mode with a wide difference and another for the cooling mode with a narrower difference. The mode, either heating or cooling, can be detected by monitoring the control signal 43 from room thermostat 42 to reversing valve control 18. Alternatively, the mode can be detected by monitoring the outdoor coil temperature and making certain assumptions about heat pumps and building control. The major assumption is that the heat pump is most likely heating below a certain coil temperature (typically 65° F.) and it is cooling above this temperature. As a result, the outdoor coil temperature will be most likely well below this "cross-over" temperature during heating, or well above it during cooling. Compressor start up may be proved by comparing the discharge-to-coil temperature difference with the appropriate setpoint after a minimum settling time from a call for compressor.

Referring to FIG. 2A, an entry point 101 "system turns on" reflects the status of the heat pump being powered up; i.e., power 17 being applied to compressor-controller 15 and any required control system electrical energization also being supplied. The system flows thence via a junction 99 and thence to logic instruction block 102 to a logic instruction block 102 "thermostat calls for compressor?" having a "no" response 103 causing flow back to junction 99 where the compressor waits for the STAT to call for compressor operation, and a "yes" response 104 (indicating a call by the STAT for compressor 14 to operate) which flows to an instruction block 105 "record time as $T_1$." This initiates or starts a timer within microprocessor 50 to enable an elapsed time measurement (T2-T1) operation as will be discussed below. The flow from 105 is through a junction 106 and thence to an instruction block 107 "connect TODCS to analog-to-digital convertor (A/D)", the flow from which is through an instruction block 108 "measure TODC", the flow from which is to instruction block 109 "select $K_1$", the flow from which is to instruction block 110 "connected TDSCHS to A/D", the flow from which is to instruction block 111 "measure TDSCH", the flow from which is to a logic instruction block 115 "TDSCH is greater than TODC plus $K_1$?" having a "no" response 116 applied to an instruction block 118 "note time as T2" and a "yes" response 119 which causes flow (see FIG. 2B) to a junction 151 and thence to a logic instruction block 152 "thermostat calls for compressor?" having a "yes" response 154 flowing to an instruction block 160 "connect TDSCHS to A/D", flow from which is to an instruction block 161 "measure TDSCH" flow from which is to an instruction block 162 "connect TODCS to A/D" flow from which is to an instruction block 163 "measure TODC" flow from which is to a logic instruction block 164 "select $K_3$" flow from which is to a logic instruction block 165 "TDSCH is greater than TODC plus $K_3$" having a "yes" response 166 flowing to junction 151 and a "no" response 167 which flows to junction 130 (see FIG. 2A).

Logic instruction block 152 has a "no" response 153 flowing to an instruction block 170 "note time as $T_3$" flow from which is through a junction 171 to an instruction block 172 "connect TDSCHS to A/D" flow from which is to an instruction block 173 "measure TDSCH" flow from which is to an instruction block 174 "connect TODCS to A/D" flow from which is to an instruction block 175 "measure TODC" flow from which is to an instruction block 176 "select $K_4$" flow from which is to a logic instruction block 177 "TDSCH is greater than TODC plus $K_4$?" having a "no" response 178 which is adapted to be connected to junction 99 and a "yes" response 179 flowing to an instruction block 181 "note time as $T_4$" flow from which is to a logic instruction block 182 "$T_4$-$T_3$ is greater than $K_5$?" having a "no" response 183 connected to junction 171 and a "yes" response 184 connected to junction 130.

Referring again to FIG. 2A the logic instruction block 115 has a "no" response 116 (indicating that the compressor start has not been proved) which flows to an instruction block 118 "note time as $T_2$".

The "no" response 116 indicates that the appropriate temperature difference $K_1$ has not been reached to indicate that the compressor is operating. A "yes" response 119 indicates that this differential has been reached and that the compressor is operating correctly.

The flow from instruction block 118 is to a logic instruction block 125 "T2 minus T1 is greater than $K_2$" having a "yes" response 126 and a "no" response 127. "Yes" response 126 thus represents the situation of a faulty compressor; i.e., after a predetermined or preselected period of time (T2 minus T1 is greater than $K_2$; we have found 5 minutes an appropriate value) the compressor has not functioned to raise the discharge temperature to a sufficiently high level as is proved by the functioning of logic instruction block 115. Accordingly, the "yes" response 126 is applied via a junction 130 to an instruction block 131 "indicate fault" (this causes actuation of indicator 63) flow from which is to an instruction block 132 "inhibit compressor". This then is effective to cause the normally open contacts 46 (of subsection 47 of microprocessor 50) to open so as to interrupt the control of compressor controller 15 by the STAT 42, and to inhibit further compressor operation.

Note that our system does not rely only upon the magnitude of TDSCH; we recognize that, to some extent, TDSCH is related to the magnitude of TODC; hence, logic instruction block 115 has a "yes" or "fault" response if TDSCH is not greater than TODC plus the preselected constant $K_1$, the value of which is selected according to the specifics of the actual equipment used.

Referring again to logic instruction 125, the "no" response 127 thereof flows to a logic instruction block 144 "thermostat calls for compressor?" having a "yes" response 145 and a "no" response 146. Thus, if STAT continues to call for compressor action then a "yes" response at 145 will flow to junction 106 and the system will continue to recycle with the timer and temperature difference functions continuing so that time T2 will increase until eventually either the equations of instructions 115 or 125 results in a "yes" response at 119 or 126 respectively as aforesaid, indicating that either the compressor 14 has started properly or that it has not started properly in the allowed time K2.

If STAT 42 is no longer calling for compressor action, then the "no" response 146 of block 144 flows to a junction 140 and thence through a connection 147 to the junction 99 and thence, as in the beginning, to logic instruction block 102.

As indicated, a means 65, e.g., a reset switch, is provided in the system to reset the entire fault detection and control system subsequent to a fault being detected and fault indicator 63 being actuated. In FIG. 2A this is reflected by logic instruction block 134 which receives the flow from instruction block 132 via a junction 133. Logic instruction block 134 "has fault reset and activated?" has a "no" response 135 flowing back to the junction 133 and thence to block 134, indicating that "reset" has not been requested, and a "yes" response 136 flowing via 140 and 147 to instructions 136 "enable compressor" and 137 "stop indication fault" and thence via junction 99 to logic instruction 102 so as to restart the system.

To summarize, it is seen that the apparatus depicted in FIG. 2A is representative of the operation of the compressor fault detection and control system (through the primary control of the microprocessor 50) to determine whether or not the compressor 14 has actually started and is actually compressing the refrigerant in the system within a preselected time interval after STAT 42 calls for compressor 14 operation. This time interval gives the compressor an opportunity to raise TDSCH to the level indicative of proper compressor operation, i.e., to a level above TODCS. It was noted logic instruction block 102 has a "yes" response at 104 when the thermostat is calling for a compressor operation; that logic instructions 107–111 relate to the measurement of TODC and TDSCH and selection of the appropriate minimum temperature K1 to prove that the compressor 14 is operating following which logic instruction block 115 determines whether or not the refrigerant discharge temperature TDSCH is greater than the outdoor coil temperature TODC plus the constant $K_1$. A "yes" response 119 from 115 is indicative of the compressor not only operating but operating in the normal fashion; i.e., compressing the refrigerant. To explain further, when the compressor is functioning in the normal mode, the compressing of the refrigerant causes a substantial increase in the temperature of the refrigerant. Thus, if the compressor refrigerant discharge temperature has not increased substantially above the outdoor coil temperature after the compressor had been running for a preselected period of time, say five minutes, then this is conclusive evidence that the compressor has a fault and it should be, at least temporarily, stopped so that an inspection may be made for the source of the problem; e.g., on open circuit breaker, etc. Thus, a "no" response 116 from 115 causes flow to logic instruction block 125 which has a "yes" response 126 flowing therefrom to 130 when the preselected time interval has elapsed; thus, if the discharge temperature TDSCH is not hot enough after the time interval, the "yes" response 126 causes the indication of a fault through the functioning of instruction block 131 causing the actuation of the fault indicator 63 of FIG. 1 and simultaneously the inhibiting of the compressor 132 which, as explained above, causes the opening of the normally closed contact 46 so as to remove control of the compressor controller 15 from STAT 42.

The fault detection and control system also functions to monitor the operation of the heat pump system during a compressor run; i.e., following the initial determination (described above) that the compressor not only is operating but is actually compressing. Thus, the "yes" response 119 from logic instruction block 115 flows to junction 151. The apparatus depicted in FIG. 2B is in part representative of the function of periodically measuring the discharge temperature TDSCH and the outdoor coil temperature TODC, then making comparisons of such successive temperature measurements and signaling a fault and inhibiting the further operation of the compressor if it is found that the most recent discharge temperature is less than, or colder than, the outdoor coil temperature measurement plus a preselected constant $K_3$.

Thus, the "yes" response 119 from logic instruction block 115 flows through junction 151 to logic instruction block 152 to determine whether or not the thermostat 42 is still calling for compressor action; if this is the case then the "yes" response at 154 causes the functions identified at 160, 161, 162, 163, and 164 to occur enabling the logic block 165 to function i.e., the determination of whether the discharge temperature is greater than the sum of TODC plus $K_3$. Parenthetically it should be noted that the value of $K_3$ is selected so that the output from 165 will be a "yes" when the system is operating normally i.e., the compressor is running so as to compress the refrigerant so that the temperature of the discharge will be high enough so that the equation of 165 will produce a "yes" at 166 continuing the flow back to 151. However, if the flow from 165 is a "no" response as at 167 then such flow goes directly to junction 130 and thence to 131 and 132 to respectively indicate a fault at fault indicator 63 and as so inhibit the operation of the compressor as described above.

Referring again to FIG. 2B consider the case of the output from logic instruction block 152 being a "no" response at 153 thus indicating that after the compressor start had been proved then the thermostat 42 no longer calls for compressor action. The apparatus of FIG. 2B provides a means for confirming that the compressor has actually turned off and is no longer compressing the refrigerant. The "no" response from 152 at 153 flows to the means 170–182 inclusive. The logic instruction block 177 determines whether or not the discharge temperature TDSCH is greater than the coil temperature TODC plus the constant $K_4$ which is preselected; if the response is "no" then this proves that the compressor has been turned off and the flow accordingly is via 178 back to junction 99 of FIG. 2A. However, if the response from 177 is a "yes" as at 179 then the flow is to 181 so that a second time can be noted as time T4 flow from which is to logic instruction block 182 wherein if it is determined that the time T4 minus the previously noted time T3 is greater than a constant K5 then the "yes" response as at 181 will flow to 130 so as to signal the fault at 131 and inhibit the compressor as at 132 as previously described. A no response from 182 as at 183 flows back to junction 171 to continue the cycle until such time as either a "yes" response flows at 181 from 182 or a no response flows at 178 back to junction 99 as described.

As indicated above, an Intel Model 8049 microprocessor may be used to practice the subject invention; as an assistance, reference may be made to "INTEL$^R$ MCS-48 TM Family of Single Chip Microcomputers—User's Manual", a 1978 copyrighted manual of the Intel Corporation, Santa Clara, Calif. 95051.

It will also be understood by those skilled in the art that the functional interconnections depicted in FIG. 1 are representative of one or more electrical wires or pipes, as the case may be, as indicated by the specific equipment used.

While we have described a preferred embodiment of our invention, it will be understood that the invention is limited only by the scope of the following claims:

We claim:

1. A compressor fault detection and control system (hereinafter "fault detection system") for a reverse cycle refrigeration system (hereinafter "system") for heating and cooling an enclosed space wherein said system comprises refrigerant compression means, refrigerant compression control means, an indoor coil, an outdoor coil, and refrigerant conduit means connecting said compression means and said coils, said fault detection system comprising:

outdoor coil temperature sensing means (hereinafter "TODCS") having an output indicative of outdoor coil temperature (hereinafter TODC");

compressor discharge temperature sensing means (hereinafter "TDSCHS") having an output indicative of the temperature (hereinafter "TDSCH") of the refrigerant discharged from said refrigerant compression means; and temperature sensing means (hereinafter "STAT") having an output indicative of a demand for heating or cooling of the enclosed space; and controller means having operative connections to said TODCS, TDSCHS, and STAT so as to receive the outputs thereof, said controller means including circuit connect-disconnect means selectively interconnecting said STAT output to said refrigerant compression control means whereby when said STAT output is connected thereto said compression means is enabled to operate and when said STAT output is disconnected therefrom said compression means is inhibited from operating, said controller means also including timing means and means for comparing the value of TDSCH and the value of TODC plus a preselected constant $K_1$, and said controller further being characterized by being adapted to inhibit said compression means from operating if, after a preselected time interval as measured by said timing means, the value of TDSCH is less than the value of TODC plus said predetermined constant.

2. A compressor fault detection and control system (hereinafter "fault detection system") for a reverse cycle refrigeration system (hereinafter "system") for heating and cooling an enclosed space wherein said system comprises refrigerant compression means, refrigerant compression control means, an indoor coil, an outdoor coil, and refrigerant conduit means connecting said compression means and said coils, said fault detection system comprising:

outdoor coil temperature sensing means (hereinafter "TODCS") having an output indicative of outdoor coil temperature (hereinafter "TODC");

compressor discharge temperature sensing means (hereinafter "TDSCHS") having an output indicative of the temperature (hereinafter "TDSCH") of the refrigerant discharged from said refrigerant compression means; and controller means having operative connections to said TODCS, TDSCHS, and to said refrigerant compression control means whereby said compression means is enabled to operate or is inhibited from operating, said controller means also including timing means and means for comparing the value of TDSCH and the value of TODC plus a preselected constant $K_1$, and said controller further being characterized by being adapted to inhibit said compression means from operating if, after a preselected time interval as measured by said timing means, the value of TDSCH is less than the value of TODC plus $K_1$.

3. Apparatus of claim 1 further characterized by said controller means including means (which is effective once a compressor start has been proved and the STAT continues to have an output indicative of a demand for heating or cooling of the enclosed space) for performing comparisons of the values of TDSCH and TODC and being effective to inhibit the operation of said compression means if the value of TDSCH is not greater than the value of TODC plus a preselected constant.

4. Apparatus of claim 1 further characterized by said controller means including means (which is effective once a compressor start has been proved and the STAT ceases to have an output indicative of a demand for heating or cooling of the enclosed space) for performing comparisons of the values of TDSCH and TODC and being effective to inhibit the operation of said compression means if, after a preselected time, the value of TDSCH is greater than the value of TODC plus a preselected constant.

5. Apparatus of claim 3 further characterized by said controller means including means (which is effective once a compressor start has been proved and the STAT ceases to have an output indicative of a demand for heating or cooling of the enclosed space) for performing comparisons of the value of TDSCH and TODC and being effective to inhibit the operation of said compression means if, after a preselected time, the value of TDSCH is greater than the value of TODC plus a preselected constant.

* * * * *